United States Patent [19]

Forbes, Jr.

[11] 4,105,155

[45] Aug. 8, 1978

[54] DIVIDED AND TAPERED FOOD CARTON

[75] Inventor: Hampton E. Forbes, Jr., Wilmington, Del.

[73] Assignee: Westvaco Corporation, New York, N.Y.

[21] Appl. No.: 839,399

[22] Filed: Oct. 4, 1977

[51] Int. Cl.[2] ..... B65D 5/28; B65D 5/50

[52] U.S. Cl. ..... 229/33; 229/38; 206/620; 229/22; 206/608

[58] Field of Search ..... 206/605, 608; 229/38, 229/41 C, 33, 41 R, 44, 22

[56] References Cited

U.S. PATENT DOCUMENTS

| | | | |
|---|---|---|---|
| 1,681,940 | 8/1928 | Lander | 229/33 |
| 2,024,832 | 12/1935 | Myers | 229/33 X |
| 2,206,314 | 7/1940 | Werner | 229/33 X |
| 2,565,188 | 8/1951 | Welshenbach | 229/41 C X |
| 3,361,329 | 1/1968 | Fox | 229/38 |
| 3,507,668 | 4/1970 | Bridgford | 229/33 X |
| 3,946,937 | 3/1976 | Forbes, Jr. et al. | 206/621 |
| 3,985,288 | 10/1976 | Bell | 229/38 |

*Primary Examiner*—Davis T. Moorhead

[57] ABSTRACT

A food carton is disclosed in the general shape of a tapered tray which includes an integral overlapping top cover portion, an integral divider element and an easy opening tear strip. In its preferred form, the carton is prepared from a one piece blank of paperboard or the like with either glued or interlocked ends located between two tapered side walls. The top flaps of the carton at least partially overlap one another with one top flap having integral therewith the carton divider element and the other top flap including the tear strip opening means. Each of the side and end walls of the carton are preferably perforated with apertures or the like to enhance the flow of air around the packaged food product and preserve its freshness.

1 Claim, 7 Drawing Figures

DIVIDED AND TAPERED FOOD CARTON

BACKGROUND OF INVENTION

The present invention relates to packaging, and more particularly, it relates to the packaging of a plurality of separate food servings, and to a carton which can advantageously support and protect the food servings in a fresh and convenient fashion.

In the art of food packaging, it has become customary to supply certain products to the ultimate consumer in individual servings both to increase sales and for the convenience of the consumer. The individual servings are preferably provided in their own separate packages to preserve the freshness of the unopened servings. This method of distributing food products provides advantages to both the consumer and the retailer. It provides the consumer with a number of individual packaged servings which need not be opened until they are needed, and it enables the retailer to more efficiently distribute his products.

Numerous types of cartons have been developed for providing individual servings of various packaged products, but there is presently no carton available for effectively and efficiently packaging baked goods substantially as disclosed herein. Baked goods should be packaged in such a manner that they are well ventilated and separated from one another, and, so that they have minimum product contact with their enclosed carton. Proper ventilation is required to provide product freshness while product separation is desired to prohibit the fusing together and attendant spoilage of adjacent products. Meanwhile, proper ventilation and minimum product contact with the enclosed carton also prevents "doughing" of the product, or the wetting and deterioration of the product where the product touches the carton. The latter problem can occur even where the individual products are separately packaged so that the products only come into indirect contact with the enclosed carton. In some cases, "doughing" of baked goods and enhanced protection of the goods from exterior crushing forces has been achieved with the use of interior cradles or separate jackets of paper or the like which are glued or otherwise adhered to the walls of the outer carton. The following list of U.S. patents is believed to be exemplary of typical cartons for packaging individual food servings, but it will be seen that none of the patents disclose a carton substantially as disclosed herein:

U.S. Pat. No. 1,227,250
U.S. Pat. No. 2,013,606
U.S. Pat. No. 3,261,461

SUMMARY OF INVENTION

It is a principal object of the present invention to provide an improved outer carton for packaging a plurality of individual packaged servings of baked goods or the like. Another object of the invention is to provide a carton which includes a plurality of individually wrapped pies such as the individually wrapped "Tasty Kake" type pies presently marketed. A further object of the present invention is to provide a method of loading a plurality of individually wrapped pies or the like into a carton which results in an easily packed carton which provides maximum protection to the packaged goods from external forces.

The carton of the present invention is preferably made from coated paperboard or the like which can be die-cut to form a one piece blank from which the carton is erected. The one piece blank can be shipped by the manufacturer to the user in a knocked down flat condition or erected by the manufacturer as desired. In either case, once the carton is filled and sealed by the user, the packaged products are ready for shipment to the ultimate retailer. Since the individual packaged products, i.e., baked goods, are prewrapped, there is no need for a liner or other product holding means in the carton.

In order to achieve the desired requirements for packaging the products with a minimum of contact between the products and the outer carton and to achieve adequate ventilation around the packaged products, the carton is preferably of a typical tapered tray design in cross section. That is, the carton has tapered side walls with straight, glued or flap locked, end walls. In addition, the carton includes a pair of overlapping top closure flaps, one of which includes an integral carton divider element, which can be adhered to one another to seal the carton after the carton is filled. The divider element serves the dual purposes of separating the prewrapped products from one another and as an aid in the filling of the carton. The carton also includes a plurality of ventilation openings in the side and end walls, and in the integral divider. And finally, for ease in opening the carton, a single line tear strip and reclosure feature is applied to one of the top closure flaps. The latter opening/reclosing feature is fully disclosed in prior U.S. Pat. No. 3,946,937 assigned to the assignee herein. For the purpose of a complete disclosure herein, the disclosure of U.S. Pat. No. 3,946,937 is incorporated herein by reference.

DETAILED DESCRIPTION

The present invention relates to a simple and effective means for packaging a plurality of individually wrapped servings of food products such as baked goods or the like. In its preferred form, the invention is directed to a carton in the general shape of a tapered tray, i.e., with tapered side walls, so that in cross section, the carton resembles a trapezoid structure with the top and bottom parallel. The carton is provided with an integral divider element attached to one of its overlapping top closure flaps and has incorporated in the other top closure flap a simple and expedient reclosable tear strip opening means.

Figure 1:
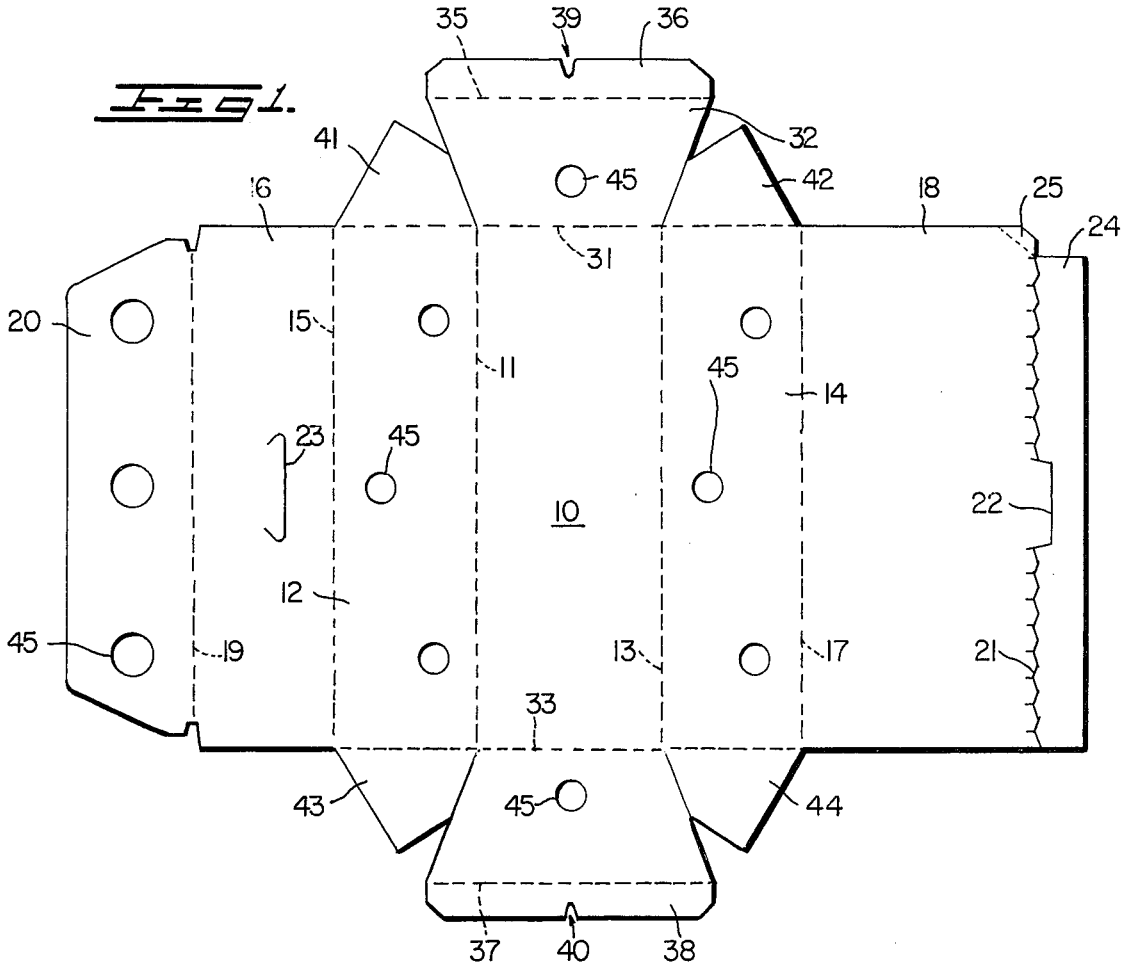
FIG. 1 is a plan view of a typical blank for constructing the carton of the present invention.

Referring more particularly to the drawings, it will be noted that the carton blank of FIG. 1 consists of a bottom wall 10 which is more-or-less centrally located on the blank. The orientation of the bottom wall 10 is dependent upon whether or not the top closure flaps are full overlap or only partial overlap. Nevertheless, for all cases, the bottom wall 10 is substantially centrally located. Attached to each side of bottom wall 10 along fold lines 11,13 are a pair of side walls 12,14. The dimensions of side walls 12,14 are dependent upon the size of the products packaged in the carton. However, these walls are preferably of sufficient heights to provide an air space above the packaged food products when the carton is closed. The carton blank also includes a pair of overlapping top closure flaps 16,18 which are attached to the side walls 12,14 along fold lines 15,17. The top closure flaps must overlap one another at least slightly in order to effect a glued or otherwise sealed closure. As shown in FIG. 1, top closure flap 16 has a width that is greater than one-half the width of the bottom wall 10 while flap 18 has a width that is greater than that of flap 16 and of bottom wall 10. The latter requirement is necessary because the tapered side walls produce a larger top wall than bottom wall for the carton. In addition, there is an integral carton divider element 20 foldably attached to top flap 16 along a score line 19. Meanwhile, top flap 18 includes the hereinbefore disclosed single line tear strip opening/reclosing feature. For this purpose, top flap 18 has incorporated therein a single perforated line 21 with an integral reclosing tab 22 which cooperates with the slot 23 in top flap 16 to reclose the carton after it is opened. The perforated line 21 in top flap 18 divides the flap into a first portion that covers a majority of the carton top and which overlaps at least to some extent the top flap 16, and, a second portion 24 that serves as the glue flap for sealing the carton closed. In addition, top flap 18 includes a carton opening tab 25 which can be used to initiate rupture of the tear line 21 for opening the carton. The latter features are described more fully in U.S. Pat. No. 3,946,937 as described earlier herein.

Figure 2:
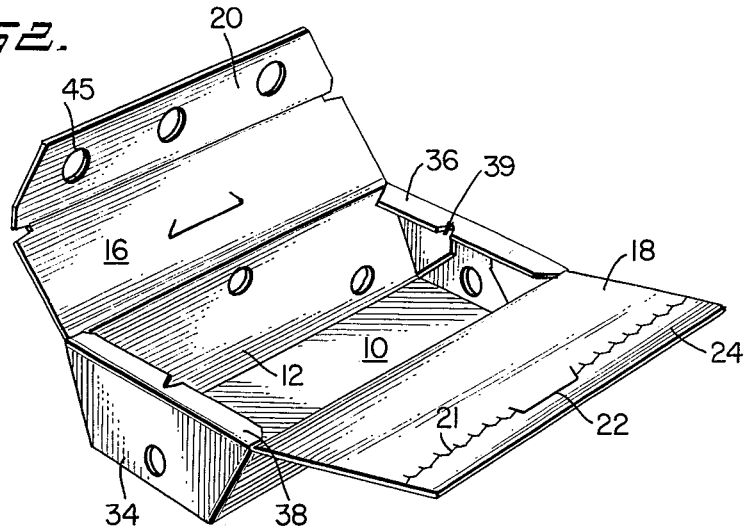
FIG. 2 is a perspective view of a carton according to the present invention as constructed from the blank of FIG. 1.

Referring further to FIG. 1, it will be seen that the bottom wall 10 also has attached to the ends thereof along score lines 31,33 a pair of end closure flaps 32,34. The end closure flaps have a width from top to bottom that is equal to the depth of the carton and include at the ends thereof minor top supporting flaps 36,38 connected thereto along fold lines 35,37. Each of the minor top supporting flaps are also preferably notched at their outboard ends with cut-outs 39,40 for the purpose of accepting the carton divider element 20 when the carton is filled and closed. Each of the notches 39,40 are located in top supporting flaps 36,38 substantially centrally thereof for the latter purpose. Meanwhile, the carton blank is shown in FIG. 1 with separate glue flaps 41,42, 43,44 connected to side walls 12,14 along the score lines 31,33. The glue flaps are adhered to the inside of end walls 32,34 as shown in FIG. 2 when the carton is formed. Glued end flaps are preferred in the present invention although other types of end closures could be used if desired. For instance, tab and slot type end closures as prepared on "Klik-Lok" packaging machinery could be used. In the latter case, the glue flaps 41,42 and 43,44 are provided with integral tabs which are automatically inserted in slots applied to the end walls 32,34.

Figure 3:
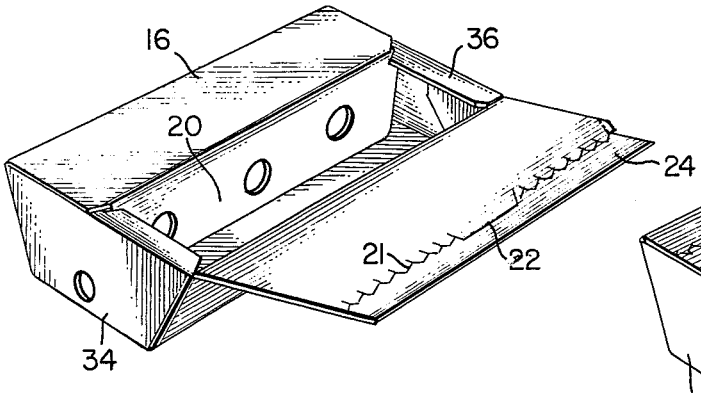
FIG. 3 is a perspective view of the carton of FIG. 2 showing the carton partially closed.
Figure 4:
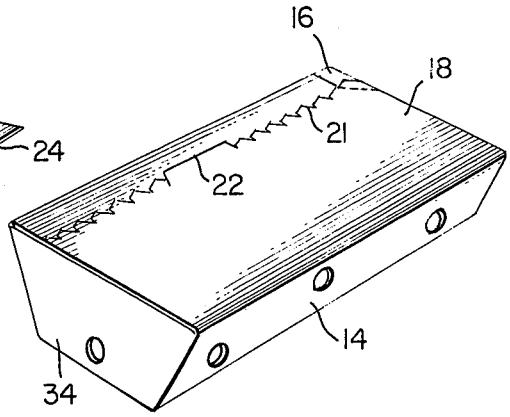
FIG. 4 is a perspective view of the carton of FIG. 3 completely closed.

FIG. 2 illustrates the carton of the present invention in its erected state. It will be seen from FIG. 2 that the top supporting flaps 36,38 are prefolded along their fold lines 35,37 into position for supporting the top closure flaps 16 and 18. The carton is then filled, one side at a time, before the top closure flaps 16,18 are folded over into closed condition. FIG. 3 illustrates the condition of the carton after the first side is filled. Top closure flap 16 rests on top of supporting flaps 36,38 and the integral divider element 20 is inserted into the slots, 39,40 provided therefor in flaps 36,38. The purpose of the divider is to keep the product initially loaded into the carton from spilling over into the second or opposite section of the carton during the second loading sequence.

Figure 5:
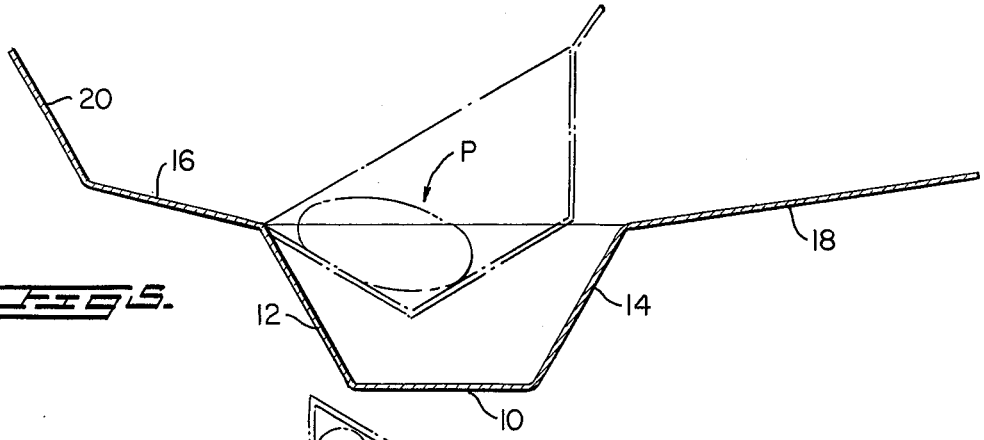
FIG. 5 is a schematic illustration of the carton of the present invention oriented for loading one side thereof.
Figure 6:
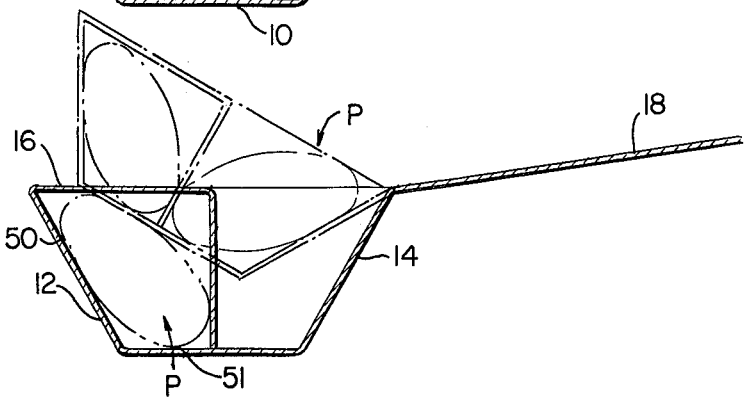
FIG. 6 is a schematic illustration of the carton of the present invention oriented for loading the opposite side thereof; and, FIG. 7 is a side view of the fully loaded carton showing how the product is located therein.
Figure 7:
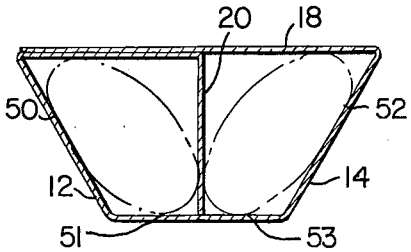

Reference to FIGS. 5-7 will demonstrate the preferred loading technique used for the baked goods for which the carton of the present invention was designed. The baked good products consist of small, single serving pies P such as "Tasty Kake" pies. The pies must be loaded into the carton in an orderly fashion to produce minimum contact between the product and the carton side walls, and for this purpose, they are preferably loaded in the carton in a substantially horizontal condition. In order to achieve this objective, when the first side of the carton is loaded, the carton is preferably tilted as shown in FIG. 5 in phantom lines to present the bottom wall 10 and adjacent side wall 12 in proper orientation to accept the substantially horizontally disposed pie P. Where the carton is designed as a family pack, several pies P are placed side-by-side in each section of the carton. After the first side of the carton is loaded, the top closure flap 16 is folded over and divider 20 is arranged in position between the slots 39,40 as shown in solid lines in FIG. 6. It will be seen in FIG. 6 that the pies P contact the carton side wall 12 and bottom wall 10 preferably only at the points designated 50,51. This minimum contact with the carton produces the desirable result of reduced doughing tendency of the baked goods during storage.

When the second portion of the carton is loaded, the partially filled carton is tilted once again in the opposite direction as shown in phantom lines in FIG. 6. In this condition, the next pies P are loaded in the carton in their preferred substantially horizontal condition to rest on the carton bottom 10 and opposite side wall 14. FIG. 7 shows the fully loaded carton with top closure flap 18 folded over the adhered to top closure flap 16. It will be seen in FIG. 7 that the pies P loaded in the second section of the carton preferably only contact the carton at the points 52 and 53.

The various Figures of the drawing each show ventilation openings 45 strategically located in the side and end walls and in the divider 20. The ventilation openings along with the minimum contact area between the pies P and the carton produce the desired freshness of the packaged products needed for multiple quantities of single servings. In addition, because of the integrity of the carton disclosed herein with the separate top closure supporting flaps 36,38 the packaged products are protected from damage that might occur during shipment. Moreover, the tear strip opening feature incorporated in the top closure flaps 16,18 provides ready access to the contents of the carton when it is desired to remove one or more of the prepackaged servings.

It should be clear that any number of individual servings might be packaged in the carton without departing from the scope of the invention. The number of servings packaged depends primarily on the length and width of the carton and the size of the servings desired.

The carton is preferably shipped in its flap blank form to the user. At that point, the carton is either glued or formed with slots and tabs prior to being filled. The carton is filled, preferably as disclosed hereinbefore, to achieve the desired freshness and minimum contact with the carton walls. Finally, after each side of the carton is filled, the top closure flaps are secured and the packaged products shipped to the retailer.

From the above it will be seen that there has been disclosed herein a preferred embodiment for a carton for packaging a plurality of prewrapped, individual servings of a baked goods products such as "Tasty Kake" pies. The carton is formed with tapered side walls in order to achieve a trapezoidal shape in cross section. The specified shape produces a construction with minimum contact between the prewrapped product and the carton walls and provides an air space between adjacent cartons when they are displayed side-by-side for sale by the retailer. The air spaces and the provision of ventilation openings in the carton side walls achieves a fresher product with minimum doughing or wetting of the dough in the pie crust where it touches the carton side walls. In addition, the provision of a divider element in the carton for dividing the carton into two separate sections aids the carton loading function and provides increased stacking strength to the carton.

Accordingly, while only a single preferred embodiment of the invention has been disclosed in detail, it will be understood that the invention is capable of numerous modifications without departing from its spirit and scope as defined in the appended claims.

I claim:

1. A divided food carton for packaging a plurality of individually wrapped servings of a food product such that the servings have a minimum contact with the top, bottom and side walls of the carton, said carton being prepared from a single blank of foldable sheet material into a configuration of trapezoidal cross section with angularly disposed side walls, comprising:

(a) a centrally located bottom panel;

(b) a pair of side walls foldably attached to opposite sides of said bottom panel;

(c) a pair of top closure flaps foldably attached to the ends of said side walls opposite said bottom panel;

(d) an integral divider element having a width substantially equal to the height of the carton foldably attached to the end of one of said top closure flaps, said one top closure flap having a width equal to one-half the width of said carton in the plane between the top of said angularly disposed side walls, and said remaining top closure flap having a width which permits it to overlap and be adhered to said one top closure flap when the carton is closed, and further including a single, substantially straight perforated tear line located prior to the point where the top closure flaps are adhered to one another, said tear line commencing at one edge of said remaining top closure flap and extending to the other edge thereof where there is located at least one unsecured carton opening tab;

(e) a pair of end walls foldably attached to opposite ends of said bottom panel;

(f) a top closure supporting flap foldably attached to each end closure flap at the end opposite said bottom panel, and further including a notch located substantially at the midpoint thereof for accepting and capturing the integral carton divider element when it is folded into position to divide the carton;

(g) a plurality of end closure flaps foldably attached to the ends of said side walls for securing the end walls of said carton to the adjacent side walls; and, (h) a plurality of ventilation openings in the side and end walls, and divider element of said carton for the purpose of preserving the freshness of the packaged food products.

* * * * *